United States Patent [19]

Pardo

[11] Patent Number: 4,703,602

[45] Date of Patent: Nov. 3, 1987

[54] FORMING SYSTEM FOR CONSTRUCTION

[75] Inventor: Jorge Pardo, Reston, Va.

[73] Assignee: National Concrete Masonry Association, Herndon, Va.

[21] Appl. No.: 795,536

[22] Filed: Nov. 6, 1985

Related U.S. Application Data

[63] Continuation-in-part of Ser. No. 773,624, Sep. 9, 1985, which is a continuation of Ser. No. 753,432, Jul. 10, 1985, abandoned, which is a continuation-in-part of Ser. No. 696,711, Jan. 31, 1985, abandoned.

[51] Int. Cl.[4] ..... F04C 2/42

[52] U.S. Cl. ..... 52/564; 52/427; 52/227; 52/566

[58] Field of Search ..... 52/562, 563, 564, 427, 52/227, 566, 293

[56] References Cited

U.S. PATENT DOCUMENTS

| | | | |
|---|---|---|---|
| 510,720 | 12/1893 | Stewart, Jr. | 52/420 |
| 994,027 | 5/1911 | O'Beirne . | |
| 1,038,257 | 9/1912 | Yourelle et al. | 52/563 |
| 1,329,893 | 2/1920 | Flynn . | |
| 1,345,156 | 6/1920 | Flynn . | |
| 1,604,796 | 10/1926 | Wiederholdt | 52/563 |
| 1,892,605 | 12/1932 | Belzler | 52/564 X |
| 1,962,906 | 6/1934 | Mueller | 52/564 |
| 2,181,698 | 11/1939 | Langenberg | 52/564 |
| 2,261,510 | 11/1941 | Atcheson | 52/564 X |
| 3,292,331 | 12/1966 | Sams | 52/405 |
| 3,676,967 | 7/1972 | Frati | 52/220 |
| 3,893,274 | 7/1975 | Salisbury | 52/330 |
| 3,999,349 | 12/1976 | Miele | 52/568 |
| 4,091,585 | 5/1978 | Rudichuk | 52/274 |
| 4,149,349 | 4/1979 | Nilsen et al. | 52/564 X |
| 4,263,765 | 4/1981 | Maloney | 52/562 |

FOREIGN PATENT DOCUMENTS 565934 11/1958 Canada ..... 52/227

OTHER PUBLICATIONS

Basalt Rock Co., Inc., Jun. 1967.
Wisconsin Concrete & Products, Assoc., Feb. 1984.
Sun, May 1984.

*Primary Examiner*—Carl D. Friedman
*Attorney, Agent, or Firm*—Lane & Aitken

[57] ABSTRACT

A forming system for construction includes thin shell concrete block elements and connecting tie members which can be assembled into forms of various shapes and sizes to receive poured concrete. The block elements are dimensioned and configured to be produced in a standard concrete block machine mold, and include alternating dovetail-shaped grooves for receiving connecting tie members and tapered grooves for breaking the vacuum between the block elements and the mold, all of the grooves being parallel to permit the blocks to be slid out of the mold. The tie members have dovetail-shaped end portions received in the dovetail grooves and a plurality of apertures which can receive a stop member to support the tie member to project a selected distance above the block elements and serve as guides for the next course of elements. The wall system is held together by a top plate bearing on the top course of block elements and anchored directly to the foundation with flexible, coilable cables. Other tie members are configured to secure the block elements to existing structures, and still others are designed to hold the block elements against earth or other fill material to define a retaining wall.

44 Claims, 21 Drawing Figures

FORMING SYSTEM FOR CONSTRUCTION

CROSS REFERENCE TO RELATED APPLICATIONS

This application is a continuation-in-part of Ser. No. 773,624, filed Sept. 9, 1985, which is a continuation of Ser. No. 753,432, filed July 10, 1985, now abandoned, which is a continuation-in-part of Ser. No. 696,711, filed Jan. 31, 1985, now abandoned.

BACKGROUND OF THE INVENTION

The present invention relates to a forming system for construction and, more particularly, to a system of forms for constructing walls, columns, piers and other structures.

The pouring of concrete walls is conventionally accomplished by erecting temporary wood or metal forms, pouring the concrete, leaving the forms in place until the concrete cures sufficiently, stripping the forms from the concrete, and erecting the forms in a new location. Unless a significant investment in additional forms is made, substantial costs in construction delays can be incurred as a result of waiting for the concrete to cure before stripping the forms, from the standpoint of both the availability of the forms for further use, and the accessibility of the concrete for further work, such as installing electrical outlets and fixtures. Furthermore, the stripping operation is costly in terms of time and money, and the forms must be replaced after several uses due to wear and tear. Moreover, when the forms are stripped away, the concrete has a rough finish having an appearance which is undesirable for many applications, and, thus, requires sandblasting, painting, covering or other treatment.

In other, related construction activity, a variety of structures are usually built using conventional concrete blocks which can be quickly produced by filling a standard concrete block mold box with concrete, applying compression and vibration, and sliding a concrete block form out of the mold. Although the block form must be allowed to harden, it becomes sufficiently firm to be slid out of the box in about 6 or 7 seconds. However, the assembly of conventional concrete blocks into a wall or similar structure is time consuming and requires a high level of skill. As a result, construction employing conventional concrete blocks is costly, with skilled labor accounting for 60%–70% of the cost of building a wall. In addition, there is little flexibility of design in a wall constructed of conventional concrete blocks, and it becomes difficult, if not impossible, to provide such a wall with insulation and convenient passages for plumbing, electrical lines and other utilities.

In order to overcome the drawbacks of reusable wood or metal forms and the limitations of conventional concrete block elements and the structures made from them, construction systems have been devised employing spaced panels made from thin shell concrete block elements in which the elements of one of the panels are tied by connecting members to corresponding elements in the spaced opposite panel. Some of these systems permit the inclusion of insulation and utility lines between the inner and outer panels, but suffer from a number of other limitations. The assembly of some of these wall systems is so complex that it is still very time consuming and requires considerable skill. In some cases, the installation of connecting members is difficult and some wall systems employ semi-rigid vertical reinforcing members, such as reinforcing rods, which tend to lean and interfere with the assembly of the thin block elements. Other wall systems use block elements having dimensions such that they cannot be accommodated in a conventional concrete block machine mold and, thus, require special molding machines, handling equipment and curing racks. Still other systems employ blocks with configurations such that they can not be slid out of a mold. As a consequence, they cannot be produced in 6 or 7 seconds, but instead must remain in the mold for a length of time on the order of 24 hours.

SUMMARY OF THE INVENTION

In accordance with the present invention, a forming system for construction includes thin shell concrete block elements and connecting tie members which can be assembled quickly and without great skill into construction forms of a wide variety of shapes and sizes for the pouring of concrete and/or filling with other materials to build a large number of different structures. The block elements and connecting tie members are designed to remain in place after the concrete cures and, thereby, eliminate the expense of stripping forms and the costs of construction delays caused by waiting for the concrete to cure in order to reuse the forms or to perform further operations on the concrete structures. In addition, various architectural surface treatments, such as ground face, prepigmentation or glazed coatings, can be provided on the concrete block elements to give to the construction form they define a finished look even before the concrete is poured.

The block elements can be produced in a standard concrete block mold machine, cured on standard curing racks and handled with conventional handling equipment. The length and width of the block elements correspond to two of the dimensions of a standard concrete block machine mold, and the thickness of the elements is such that a plurality of them can be accommodated at one time in a standard mold box. Each block element includes a plurality of alternating dovetail-shaped grooves and tapered grooves which immediately break the vacuum between the block element and the mold, thereby reducing the forces tending to retain the block element in the mold. One-half of a dovetail groove is formed at each end of the block elements so that abutting block elements define composite dovetail grooves, which are the same in size and shape as the dovetail-shaped grooves defined entirely in one block element. All of the grooves are parallel to allow the block element to be slid out of the mold in about the same number of seconds as is required for a conventional concrete block.

By having dovetail-shaped end portions received in the dovetail grooves, the tie members connect the block elements of a first panel to corresponding block elements of a second panel or other anchorage, and they connect the block elements of each course to block elements in adjacent courses. The end portions have associated stop members for abutting the block elements at the top of the grooves to allow the tie members to project a selected distance above the block elements and thereby serve as guides for the next course of block elements. A web portion extends between the end portions and includes a central opening for receiving and supporting utility lines, as well as for allowing the distribution of poured concrete, and formations for holding horizontal and vertical reinforcing elements.

A structure made from the forming system according to the present invention can be assembled without mortar and can be held together by a top plate bearing on the top course of block elements and anchored to a foundation by a flexible cable which can be uncoiled as the structure is assembled. A cable tensioning anchor grips the flexible cable and transmits the tension in the cable to the top plate, which can be received in a seat defined by recessed portions of the block elements in the top courses of the first and second panels.

Rather than being filled entirely with concrete, the space between the panels can be left void, can include insulation or other materials, or can include any suitable combination of concrete, insulation, other materials and voids.

DETAILED DESCRIPTION OF THE PREFERRED EMBODIMENTS

Figure 1:
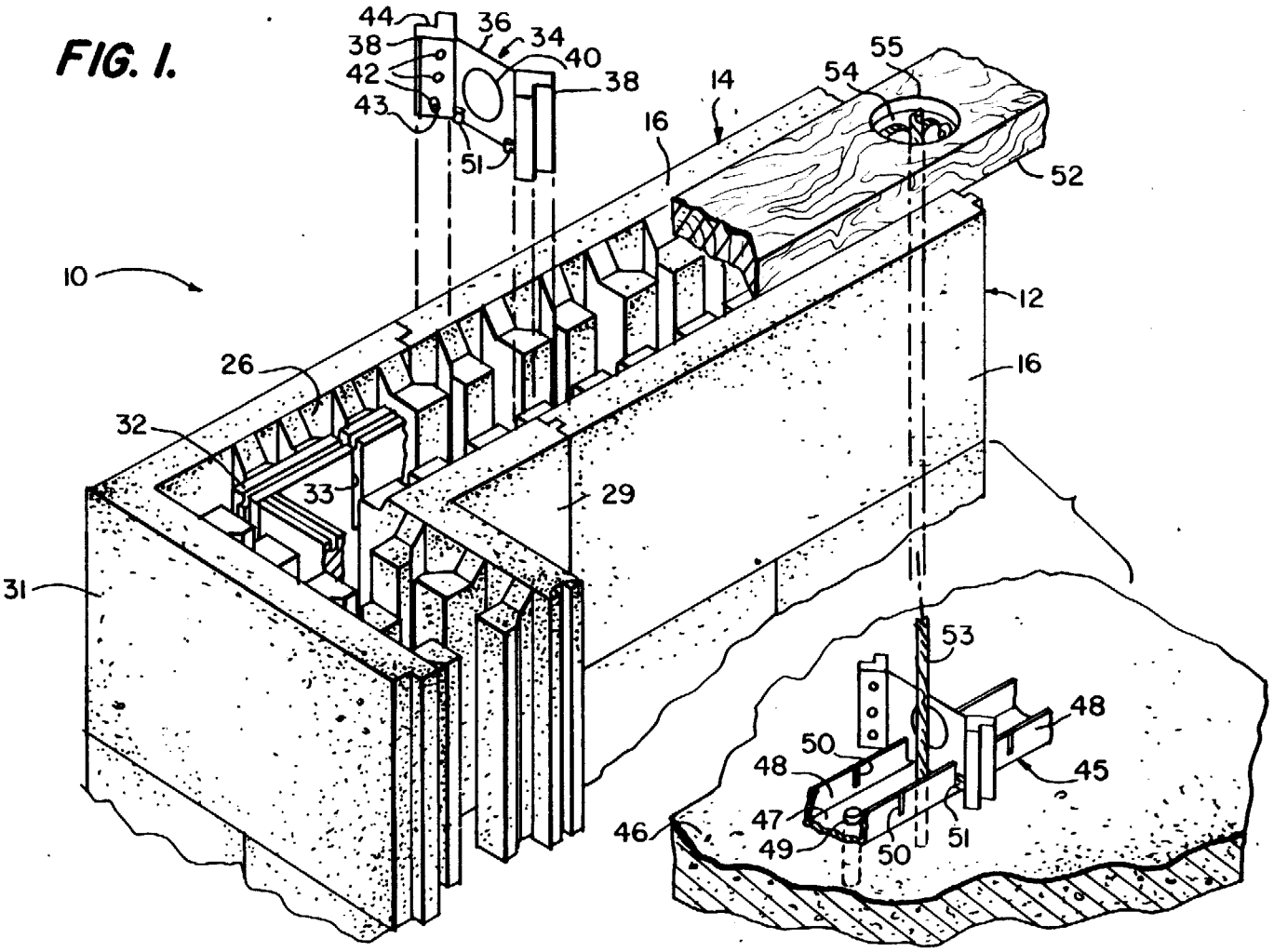
FIG. 1 is a perspective view of the construction forming system according to the present invention.

In FIG. 1 of the drawings, an exemplary embodiment of a forming system for construction 10 according to the present invention is shown as having a first panel 12 and a second panel 14 each made up of a plurality of thin shell concrete block elements 16.

Figure 2:
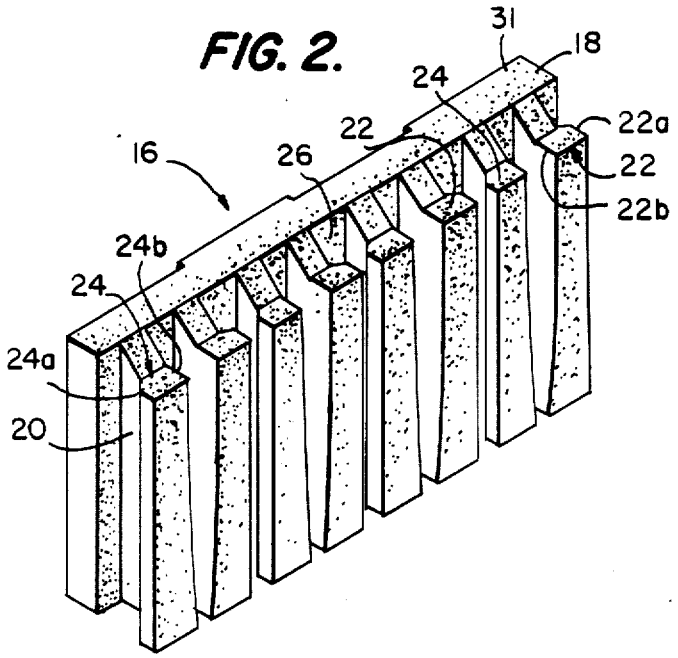
FIG. 2 is a perspective view of one of the thin shell block elements in the forming system of FIG. 1.

As can best be seen from FIG. 2, each block element 16 includes an elongate planar portion 18 and a plurality of spaced ribs 20 projecting from the planar portion 18 and terminating in broadened feet 22 and 24, which include toe portions **22*a* and 24*a*, respectively, and heel portions 22*b* and 24*b*. The planar portion 18 includes peripheral surfaces, and each rib 20 has one end which is spaced from one of the peripheral surfaces to define a recess and an opposite end which is flush with another of the peripheral surfaces. The toe portions 22*a* and 24*a* extend toward one another and define with the ribs 20 and the planar portion 18 dovetail-shaped grooves 26 having a closed bottom defined by the planar portion 18 and a narrower, open top opposite the closed bottom. One-half of a dovetail groove is formed at each end of the block elements 16, so that block elements 16 abutting at their ends define composite dovetail grooves which are the same in size and shape and the dovetail grooves 26 defined entirely in one block element. Tapered grooves 28 are defined between the heel portions 22*b* and 24*b* of adjacent feet 22 and 24 in cooperation with the ribs 20 and the planar portion 18. The tapered grooves 28 taper along their length to provide a mechanism for breaking the vacuum between the tapered grooves 28 and the mold as the block elements 16 are slid from the mold. The breaking of this vacuum reduces the overall forces retaining the block elements 16 in the mold, so that the elements can be removed easily. The configuration of the block elements 16, that is, having all of the grooves parallel to one another, permits the elements to be slid out of the mold. The block elements are dimensioned to permit them to be molded readily in a standard concrete block mold box and, for this reason, a preferred embodiment of the block element has nominal dimensions of 16 in.×8 in.×2.5 in. For a block element having these dimensions, a mold box which can produce, for example, three standard concrete blocks at one time can produce 6 thin shell block elements at a time. These thin shell block elements fit precisely in standard concrete block curing racks and can be handled with conventional handling equipment. The construction system 10 according to the present invention can also include corner block elements, such as the inner corner block element 29 and the outer corner block element 30 shown in FIG. 1**, both of which can be produced in a standard concrete block machine mold.

The dimensions of the block elements 16 are such that an integral number of the elements equals the dimensions of standard size fixtures, such as standard size windows and doors. In addition, the block elements 16 have the advantage of modularity, since the elements can be cut along a dovetail groove 26 to provide elements of ½, ¾ or ¼ size, for example, which mate precisely with full size block elements. In addition, raised bar portions 31 can be provided on the surface of the planar portion 18 opposite the grooves, the edges of the bar portions defining the lines along which the block element can be cut to achieve modularity.

The block elements 16 of the first panel 12 and the second panel 14 of FIG. 1 are positioned in alignment with one another and with their ribs 20 projecting toward one another so that a space is formed between the opposing feet. Many options are available for the space between the block elements 16 of the first and second panels 12 and 14. The space can be left void, or can include insulation of various types or combinations of types. For example, insulation in board form 32 can be placed in the space between the opposing feet 22 and 24, or foam or granular insulation can be used instead, or the foam or granular insulation can be placed on the interior side of the board insulation, filling the grooves 26 and 28 of the block elements 16 in the inner panel 12. Where board insulation is used, it is placed as close as possible to one of the panels, and as close as possible to the exterior panel where an exterior wall is involved, and the boards 32 can have a height equal to the height of the block elements 16, so that the top of the insulation will be even with the top of the block elements regardless of the number of courses of block elements in a wall. As can be seen from FIG. 1, the boards 32 of insulation are provided with tongues and grooves along their edges to interengage with adjacent boards in the same plane, although there is no interengagement where the boards meet at a right angle. It is contemplated than a tongue be defined on one side edge and one end edge of each board and that a groove be defined on the other side edge and end edge, although other arrangements may be used. Alternative interengaging board edge configurations, such as shiplap, are also suitable. In addition, slots 33 are provided in the boards 32, for example, from both edges of the boards toward the center and in alignment with each of the dovetail grooves 26 and each of the composite dovetail grooves, to accommodate tie members to be described hereinafter. It is normally desirable to omit insulation from the grooves in the block elements 16 of the outer panel 14 to provide drain channels for condensation. Another option for the space between the panels 12 and 14 is to fill the entire space, including all of the grooves, with poured concrete, thereby providing a poured concrete wall in which the block elements 16 are, in effect, the forms. Another alternative is to place insulation or other material in a portion of the space and to pour concrete in the rest of the space, or to pour concrete and leave selected portions of the space void, or to pour concrete in connection with voids and materials, such as insulation. Where they are used with poured concrete, the block elements 16 remain in place when the concrete has cured and, thereby, provide a fast and efficient system for erecting a poured concrete wall.

The block elements 16 of the first panel 12 are connected to corresponding block elements in the second panel 14 by tie members 34, as can best be seen in FIGS. 1, 3, 4 and 21. Each tie member 34 has a central web 36 extending between dovetail-shaped end portions 38 which are received in the dovetail grooves 26 of the block elements 16, primarily in the composite dovetail grooves, and are retained therein. The web 36 has a large central opening 40 for receiving and supporting utility lines, such as plumbing or electrical lines. Each end portion 38 includes a plurality of apertures 42 spaced from one another in a direction parallel to the axis of the end portions 38 and to the dovetail grooves 26 which receive them. A thin element 43, such as a nail, may be inserted into any one of the apertures with a portion of the element projecting from the dovetail-shaped end portion 38 to abut the end of one of the feet 22 or 24 of the block element 16. The projecting thin elements 43 are accommodated in the space between the recessed ends of the ribs of one block element and the flush ends of the ribs of the adjacent block element. Thus, the projecting thin elements 43 act as stop members which prevent the tie members 34 from sliding all the way down into the grooves 26, and support the tie members 34 so that they extend above the upper edge of the block elements 16. As a result, the upwardly extending tie elements 34 are guides in helping a workman to position the block elements of the next course and as a mechanism for holding the next course of block elements in place. Thus, each end portion 38 is contained in a dovetail groove 26 of a block element 16 in one course and in a dovetail groove of a block element of an adjacent course, as is shown for end portions 128 in FIG. 13 and end portions 136 in FIG. 16, which will be described hereinafter. Therefore, the tie members 34 connect vertically adjacent block elements 16 and thereby hold together the block elements in each of the first and second panels 12 and 14.

The particular one of the apertures 42 selected determines how far the tie member 34 will extend upwardly, and the selection is based in part on whether the recessed ends of the feet are near the upper edge of the block elements 16, as is shown in FIG. 1, or if the ends of the feet which are flush with an edge of the block elements 16, and shown at the bottom of the elements in FIGS. 1 and 2, are facing up. The thin elements 43 projecting from the apertures 42 tend to tilt in the apertures 42 to assume an angle which helps wedge the tie members 34 in place.

The lateral peripheral surfaces of the planar portion 18 of the block elements 16 can be planar, as shown on the block element 16 of FIG. 2, or can have an interconnecting tongue-and-groove or shiplap arrangement, as shown in the first panel 12 and second panel 14, respectively, in FIG. 1. Such lateral connection provides the wall defined by the forming system 10 with even greater integrity. Although only tongue-and-groove and shiplap configurations are illustrated, other interengaging configurations may be used, as long as the configurations permit the block elements to be slipped out of a mold. Furthermore, the tongue-and-groove and shiplap arrangements have been shown in the same wall for ease of illustration, but it is likely that a single type of interengaging configuration will be employed throughout an entire wall or other structure.

Figure 3:
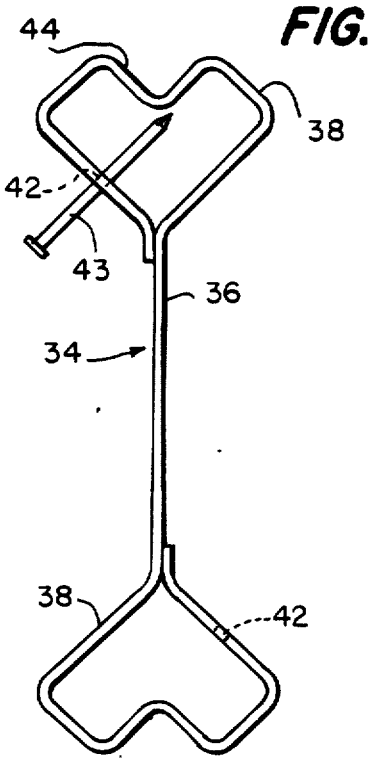
FIG. 3 is a top view of the tie member in the forming system of FIG. 1.

The dovetail-shaped end portions 38 include indentations 44 which define a channel in the dovetail grooves 26 between the end portions 38 and the planar portion 18 of the block elements 16. This channel allows the drainage of condensation. In one of the preferred embodiments, as is best illustrated in FIG. 3, the tie member 34 is made from sheet metal which is bent into the required shape. Such a tie member 34 can be formed quickly and inexpensively, and the fact that the height of each tie member needs to be only a portion of the length of a dovetail groove 26 results in savings in material and makes the handling of the tie members easier, since it reduces their size and weight and since hundreds of such tie members must be moved to and around a job site. Although sheet metal tie members have been specifically described, the tie members 34 can also be made of other materials, such as plastic or fiberglass. Ordinarily, the tie members 34 placed just in the composite dovetail grooves have sufficient strength to connect the block elements 16 in the first panel 12 to corresponding block elements in the second panel 14, but additional tie members 34 can be employed in other dovetail grooves where greater strength is desired.

Figure 4:
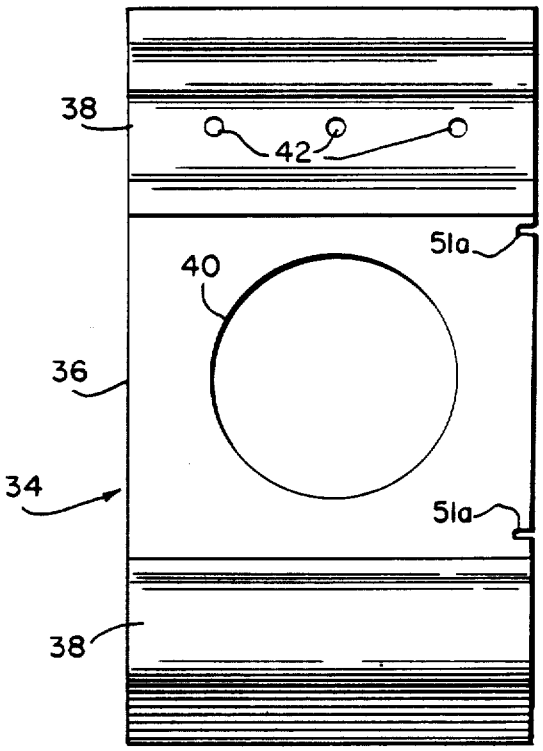
FIG. 4 is a side view of the tie member of FIG. 3.

The construction system 10 permits a wall to be assembled without the use of mortar, although mortars, adhesives and/or gaskets may be utilized in certain applications, and assembly of the wall can be started by positioning the block elements 16 of the first and second panels along a base channel 45 of, for example, metal or plastic, which is secured to a foundation 46. The preferred embodiment of the base channel 45, which is illustrated in FIG. 1, has a bottom wall 47 and side walls 48 along which the first course of block elements 16 is positioned with the feet 22 and 24 of the ribs 20 engaging the exterior surfaces of the side walls 48. Conventional fasteners 49 may be used to secure the base channel 45 to the foundation 46, which may be concrete, and openings can be defined in the bottom wall 47 to receive the fasteners 49. Alternatively, the fasteners 49 can be punched through the material of the bottom wall 47 as they are secured to the foundation 46. The side walls 48 define a plurality of slots 50 for receiving the web portions 36 of tie members 34. The slots 50 are spaced from one another by a distance such that they are in alignment with the dovetail grooves 26 of the block elements 16 so that the end portions 38 of the tie members 34 placed in the slots 50 are received in the dovetail grooves 26 in order to fix the block elements 16 in proper positions relative to the length of the base channel 45 and to retain the block elements against the base channel for establishing the proper distance between the first and second panels 12 and 14. Centering lugs 51 are defined on the web portions 36 of the tie members 34 and are separated from one another by a distance just greater than the width of the base channel 45 so that the centering lugs 51 engage the exterior surfaces of the side walls 48 adjacent to the slots 50. By such engagement, the tie members 34 are centered with respect to the base channel 45 and the end portions 38 extend beyond the side walls 48 by the correct distance for being received in the dovetail grooves 26 of the block elements 16. As an alternative, the function served by the centering lugs 51 could be served by slots 51*a* extending into the web 36 in a position to cooperate with the slots 50 in the side walls 48 of the base channel 45, as are shown in FIG. 4.

The entire wall can be held together by a top plate 52 bearing on the top course of the block elements 16 of both the first and second panels 12 and 14. The top plate 52 can be made of wood or metal and is held down against the block elements 16 by flexible cables 53, one of which is shown in FIG. 1, which can be anchored to the foundation 46 and uncoiled as the courses of block elements 16 are positioned on top of one another. Where wood top plates are employed, floor joists or roof supports can be nailed to them. The use of the flexible, coilable cables 53 permits the cables to be unwound to the necessary length as the wall rises and does not tend to knock block elements 16 out of position as a leaning rod would. The cables 53 can be made of, for example, steel or fiberglass, and the tension of each cable can be transmitted to the top plate 52 by a fastener such as a cable tensioning anchor 54, which will be described in greater detail hereinafter, counterbore 55 in the top plate 52. The top plate 52 can bear against the recessed ends of the feet 22 and 24 which define a recessed seat for the top plate, or it can rest against the ends of the feet which are flush with the edge of the planar portion 18 of the block elements 16.

Figure 5:
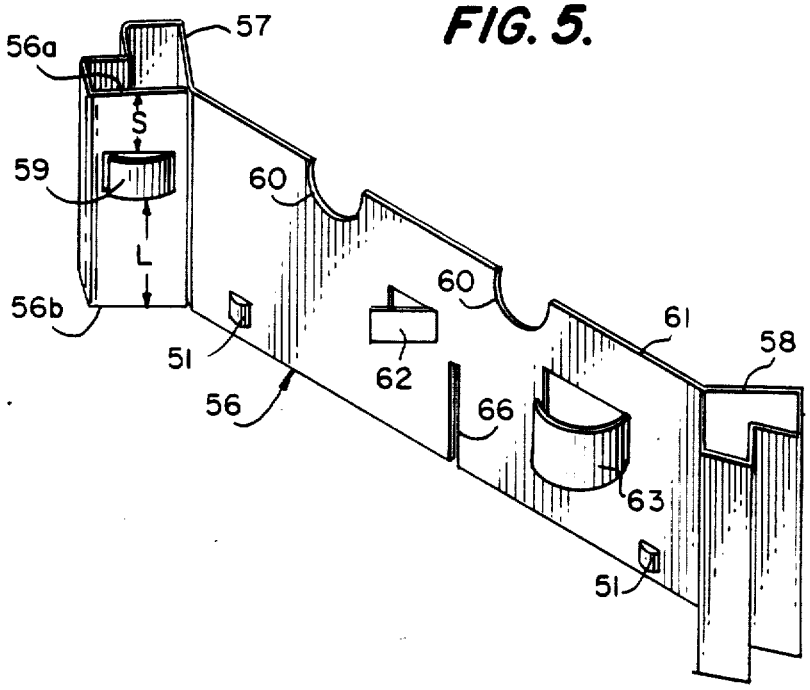
FIG. 5 is a perspective view of an alternate embodiment of the tie member according to the present invention.

FIG. 5 illustrates an alternative embodiment of a tie member 56 having end portions 57 and 58 which include integral projections 59 to extend over and engage a rib 20 of a block element 16 at the end of a dovetail groove 26. The projections 59 may be struck out from the material of which the tie member 56 is made, especially if sheet metal is used, and may be positioned closer to one axial extent of the end portion than the other so that the tie member may extend the same distance above a course of concrete block elements 16, regardless whether the recessed end of the ribs or the ends of the ribs which are flush with the planar portion support the projections 59. More specifically, each projection 59 can be positioned so that it defines a short axial dimension S between the projection 59 and one edge 56*a* of the connecting tie member 56 and a long axial dimension L between the projection 59 and an opposite edge 56*b* of the connecting tie member 56. Thus, if the tie member 56 is oriented so that the short axial dimension S of the end portions 57 and 58, between the integral projections 59 and the edge 56*a* of the tie member enters the dovetail groove, the tie member 56 will be supported relatively far beyond the ends of the ribs 20. On the other hand, if the tie member 56 is oriented so that the long axial dimension L of the end portions 57 and 58, between the integral projections 59 and the edge 56*b* of the tie member, enters the dovetail groove, the tie member 56 will not be supported as far beyond the ends of the ribs 20. If the short and long axial dimensions S and L, respectively, are chosen so that the difference between them equals the distance between the recessed ends of the ribs 20 and the adjacent peripheral surface of the planar portion 18, the insertion of short axial dimension S into the ends of the grooves at which the ends of the ribs 20 are recessed from one peripheral surface of the planar portion 18 results in the tie members 56 projecting beyond the peripheral surface by the same distance as tie members whose long axial dimension L has been inserted in the ends of grooves at which the ends of the ribs 20 are flush with the peripheral surface of the planar portion 18.

In addition, as can be seen from FIG. 5, notches 60 may be formed in an edge of the web portion 61 of the tie member 56 to support transverse reinforcing members, such as steel reinforcing rods, and prevent them from shifting. Similarly, guide lugs 62 and 63 may project from the web portion 61 to retain reinforcing elements which extend transverse to the length of the tie member 56 and orthogonal to the reinforcing elements supported in the notches 60. The lugs 62 and 63 may, like the projections 59, be formed in a punching operation, and the lug 63 is curved to be more complementary to the reinforcing element it guides. Although the lug 62 has been illustrated as planar and the lug 63 as curved, ordinarily both lugs on a given tie member will have the same shape, that is, both will be either planar or curved. In addition to the features shown in FIG. 5, openings, such as the opening 40 in the tie member 34, may be employed in the tie member 56 to accommodate utility lines.

Figure 6:
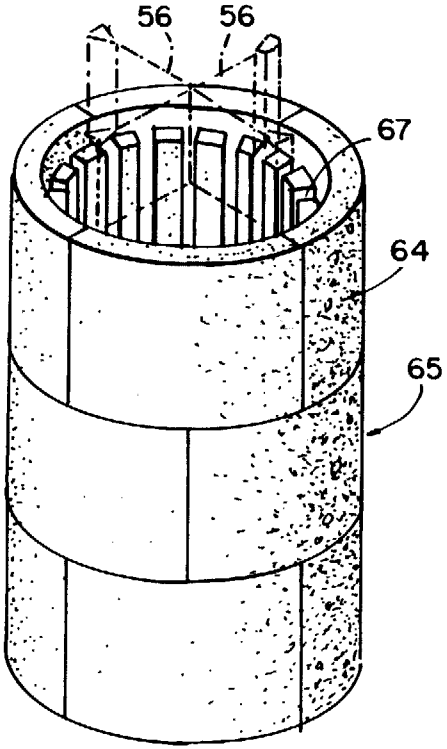
FIG. 6 is a perspective view of a column formed from thin shell block elements having a generally arcuate shape.

As can be seen from FIG. 6, arcuate thin block elements 64 can be employed to construct structures having arcuate cross sections, such as the circular column 65. The opposite arcuate block elements 64 can be held to one another by the tie members 56, which are shown schematically. Where the tie members intersect, slots may be defined in each one to cooperate in allowing the tie members to occupy the same vertical space at their intersection. For example, an openended slot 66 (FIG. 5) can extend from one edge 56*b* of the connecting tie member 56 halfway through the web portion 61 and another tie member 56 can include a complementary slot extending halfway through the web portion from the opposite edge 56*a*, the slots cooperating with one another so that the edges of one connecting tie member 56 are coplanar with the edges of the other tie member. Alternately, tie members extending radially in different directions can be positioned above and below with respect to one another and may extend vertically for a distance less than the entire length of a dovetail groove 67. Although the circumference of the circular column 65 illustrated in FIG. 6 is defined by four arcuate block elements 64, it is understood that other numbers of such elements can be employed to define the circumference. Furthermore, although two ties have been illustrated to hold together each course of arcuate block elements 64, three or four or other numbers of ties can be employed and the length of the ties can vary to accommodate different distances between opposing dovetail grooves 67. Moreover, where the column 65 is used as a form for pouring concrete, the concrete fills the dovetail grooves 67, thereby additionally securing the arcuate block elements 64 to the concrete when it cures, and the arcuate block elements add to the strength of the column. Moreover, the utility openings in the ties make the ties lighter and serve to aid the distribution and flow of concrete throughout the wall, column or other structure defined by the block elements and, thereby, prevent voids in the poured concrete. The block elements 64 may also be added to an existing column in order to improve its appearance, for example. In such a case, tie members may be used which have one end complementary to the dovetail grooves 67 for reception thereby, while the other end has a configuration, such as a flange, to permit devices, such as concrete anchoring bolts to secure the block elements 64 to the existing column. The concrete block elements may also be added to an existing steel column for fireproofing.

Figure 7:
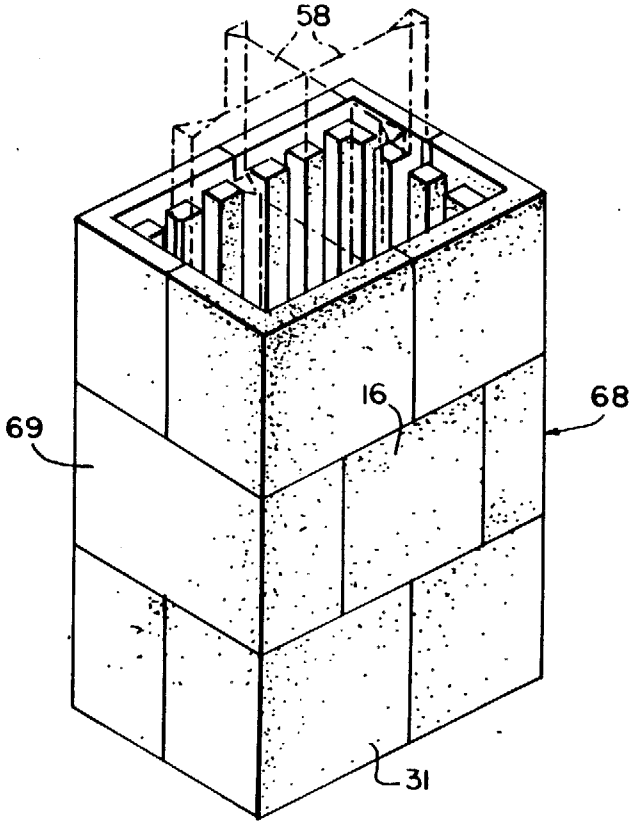
FIG. 7 is a perspective view of a rectangular column formed from thin shell block elements, some of which have an angled shape.

As can be appreciated from FIG. 7, the column forming capability of the concrete block elements according to the present invention is not limited to columns having an arcuate cross section, but may also include columns having a polygonal cross section, such as the rectangular cross section illustrated. The rectangular column 68 includes exterior corner block elements 31 and planar block elements 16, as well as elements 69 having a channel shape with leg portions extending parallel to one another from the opposite ends of a planar portion.

Figure 8:
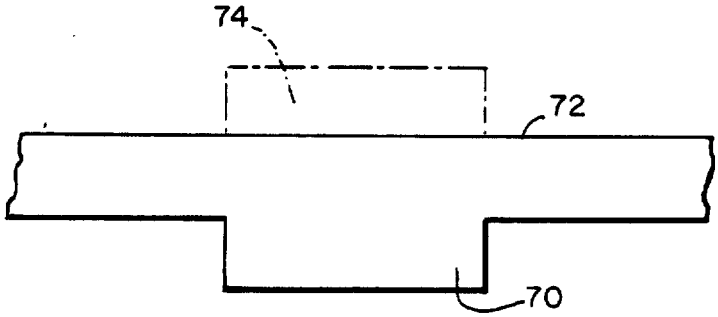
FIG. 8 is a schematic plan view of a pier constructed of thin shell block elements according to the present invention and built into a wall.

In addition to their ability to be used in connection with freestanding columns, the concrete block elements can be employed in defining a pier 70 as illustrated in FIG. 8 in connection with a wall 72 or other structure. The pier can be defined by block elements extending from one side of the wall 72, as represented by the pier 70, or additional block elements can extend from the opposite side of the wall 72, as in the portion 74 shown in dotted lines, to define a pier extending from both sides of the wall 72.

Figure 10:
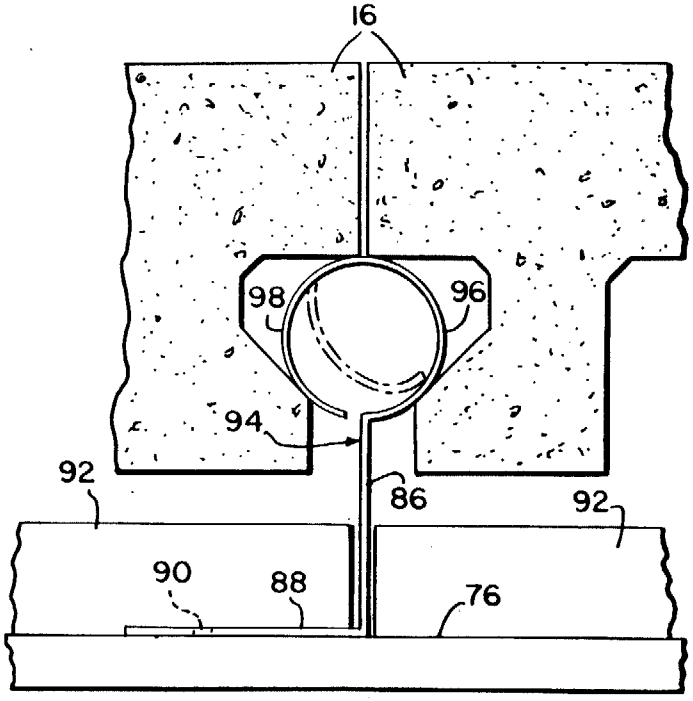
FIG. 10 is a plan view of an alternate embodiment of a tie member connecting the thin shell elements to other structures.
Figure 9:
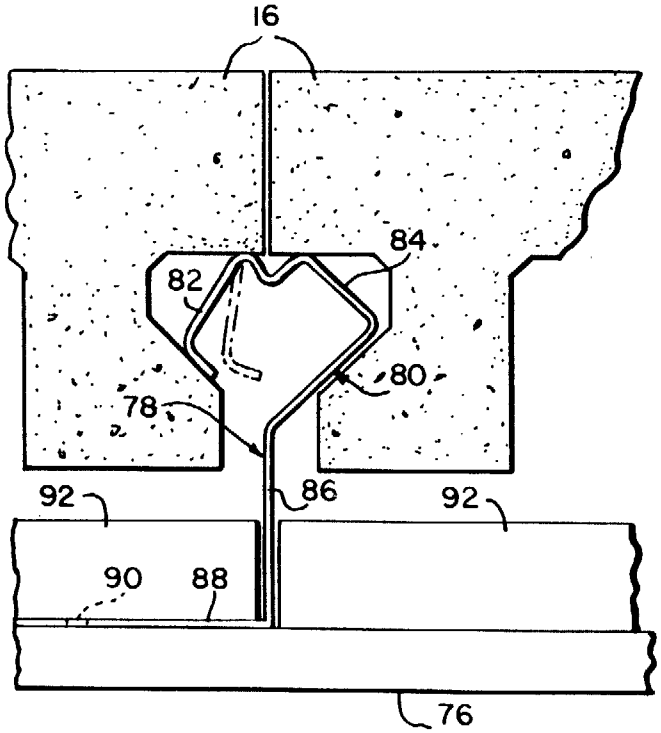
FIG. 9 is a plan view of a tie member connecting thin shell block elements according to the present invention to other structures.

FIG. 9 illustrates one embodiment of a tie member for securing concrete block elements according to the present invention to an existing structure 76. The tie member 78 includes a relatively rigid end portion 80 complementary to a composite dovetail groove defined between abutting ends of the two concrete block elements 16 and is well suited to be formed from sheet metal. As an alternative, at least a tab 82 of the end portion 80 may be sufficiently resilient that the block element 16 engaging the tab 82 can be pushed past the end portion 84 toward the existing structure 76, thereby deflecting the tab, which defines a free edge, to the position shown in phantom, and then allowing the tab to return to its relaxed, solid line position engaging and retaining the block element 16. Thus, each block element 16 can be inserted endwise against the side of the end portion 84 connected to the web portion 86, and the opposite end of the block element can be snapped over the resilient tab 82 of the tie member 78 adjacent that end. A web portion 86 of the tie member 78 has connected at its opposite end a flange 88 defining an angle with the web portion and having one or more apertures 90 to receive fasteners appropriate for securing the flange 88 to the material of the existing structure 76. If desired, insulation, such as in the form of boards 92, can be installed on the existing structure 76, over the flanges 88. An alternate tie member 94 is similar to the tie member 78, but includes an end portion 96 having a generally circular configuration including an arcuate end portion 98 which may be relatively rigid or flexible like the tab 82 of the FIG. 9 embodiment, for complementing and mating with the composite dovetail groove. Although the tie members illustrated in FIGS. 9 and 10 are shown engaging composite dovetail grooves, it is understood that they can also be received in dovetail grooves defined entirely in one concrete block element.

Figure 12:
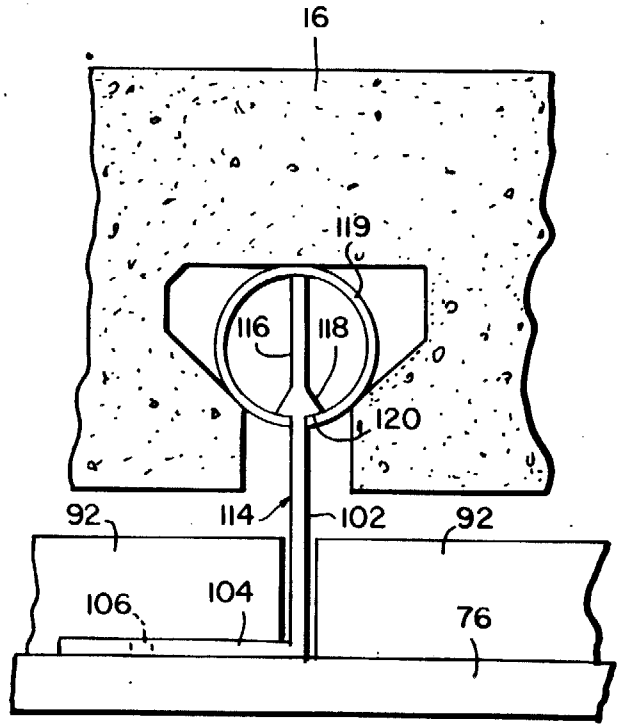
FIG. 12 is a plan view of yet another embodiment of a tie member connecting thin shell block elements to other structures.
Figure 11:
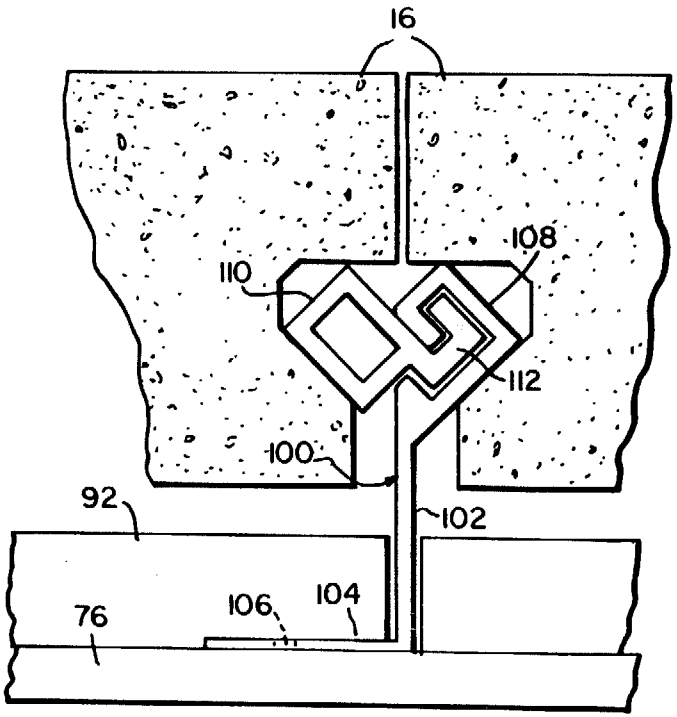
FIG. 11 is a plan view of another embodiment of a tie member connecting thin shell block elements to other structures.

The tie members described heretofore have been made from one piece, but the present invention also contemplates two-piece tie members, as can be seen from FIGS. 11 and 12. In such members, one end portion of each tie member has a first piece which is integral with the web portion and a second piece which can be slidably received on the web portion or the first piece in order to define with the first piece an end portion configuration which fits snugly within the dovetail-shaped groove. Thus, the end portion is wider than the relatively narrow open top of a dovetail groove but narrower than the relatively wide closed bottom of the groove. The tie member 100, which is illustrated in FIG. 11, has a web portion 102 and a flange portion 104 defining an angle with the web portion, the flange portion 104 including one or more apertures 106 for receiving fasteners to secure the flange 104 to the existing structure 76. At the end of the web portion 102 opposite the flange 104, an angularly curled end portion 108 is shaped to be complementary to a dovetail groove in cooperation with a sliding element 110 having a mating portion 112 shaped to mate with the angularly curled portion 108. The block elements 16 can be secured by the tie members 100 to the existing structure 76 by abutting one end of a block member 16 against the angularly curled end portion 108. The adjacent block element 16 can then be placed in abutment with the first block element and the sliding element 110 inserted by sliding it into the composite dovetail groove so that the mating portion 112 is received in the angularly curled end portion 108. As an alternative, the sliding element 110 can first be positioned in the angularly curled end portion 108 and the block elements 16 can be slid into position in a direction parallel to the length of the grooves. This alternate manner is also applicable to dovetail grooves which are defined entirely within one block element 16.

Another two-piece tie member 114 is similar to the tie member 100 except that an end portion 116 received in the dovetail groove is coplanar with the web portion 12 and includes a tapered protrusion 118 extending from the end portion 116 at its junction with the web portion 102. The second member is a split annular element 119 defining a gap at the split and being slidable with respect to the dovetail groove and the end portion 116, the split annular element being retained from movement away from the web portion 102 by a base surface 120 of the protrusion 118. In assembling block elements 16 using the tie member 114, the dovetail groove, whether composite or defined entirely within one block element, can be placed over the end portion 116 and then the split annular element 119 slid into the dovetail groove so that the gap engages opposite surfaces of the tie member 14 in engagement with the base surface 120. As an alternative, the split annular element 119 can be placed in the dovetail groove, in which it is dimensioned to fit snugly, and then the groove, with the split annular element 119 in it, can be pushed onto the tie member 114 so that the ends of the split annular element 119 at the gap engage the tapered surfaces of the protrusion 118, thereby spreading the ends until the protrusion 118 is within the split annular element, whereupon the ends return to their relaxed position by their own resiliency and engage the base surface 120, thereby retaining the split annular element 119 on the end portion 116 of the tie member 114 and the block element 16 on the existing structure 76. In a further embodiment, the split annular element 120 can be permanently secured to the end portion 116. The embodiments illustrated in FIGS. 11 and 12 are both suited to be made of a resilient plastic material, although one or both members of each two piece tie member can be made from other suitable materials.

Figure 13:
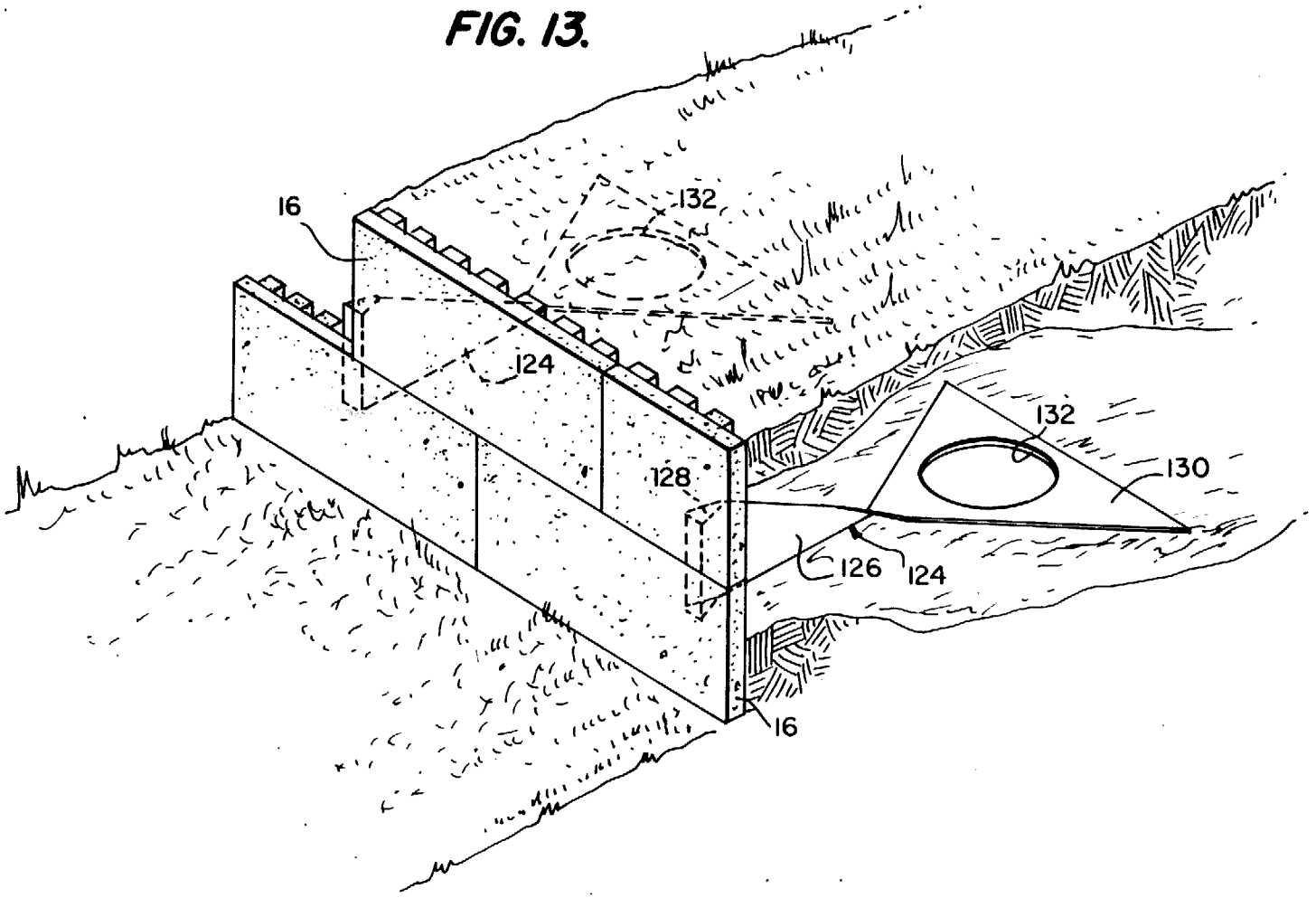
FIG. 13 is a perspective view of thin shell elements and tie members defining a retaining wall.

As can be seen from FIG. 13, the block elements according to the present invention, such as the planar concrete block elements 16, can be used to build a retaining wall when they are used in connection with appropriate tie members, such as the tie members 124 illustrated. The tie members 124 can be received either in composite dovetail grooves defined between adjacent concrete block elements or in dovetail grooves defined entirely by one block element, and they include a web portion 126 connecting at one end to an integral end portion 128 received in the groove and terminating at an opposite end in a planar end portion 130 of a relatively large area which has been twisted relative to the web portion so that the plane of the end portion 130 is orthogonal to the plane of the web portion 126. The weight of the earth or other fill material held in place by the retaining wall bears against the end portion 130 and fills an opening 132 defined in the end portion. The end portions 130 illustrated are triangular in shape and a single opening 132 is shown, but it is understood that other end portion shapes and different numbers and locations of openings may also be used. Retaining walls constructed by the system just described eliminate the need for footings, like those needed for poured concrete or conventional concrete block retaining walls. Block units of half height can be provided so that a more precise height of the retaining walls can be achieved.

Figure 15:
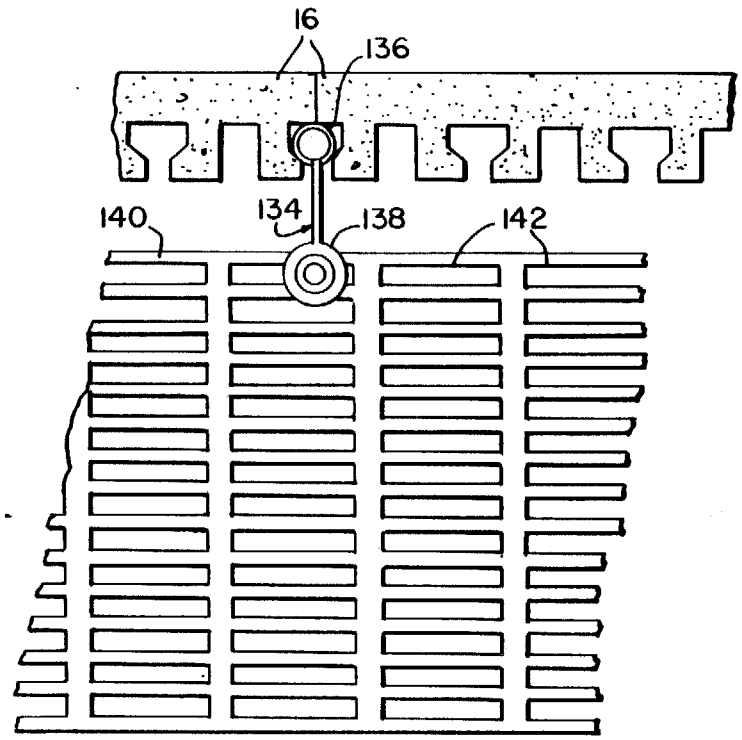
FIG. 15 is an alternate arrangement of the anchoring grid of FIG. 14.
Figure 14:
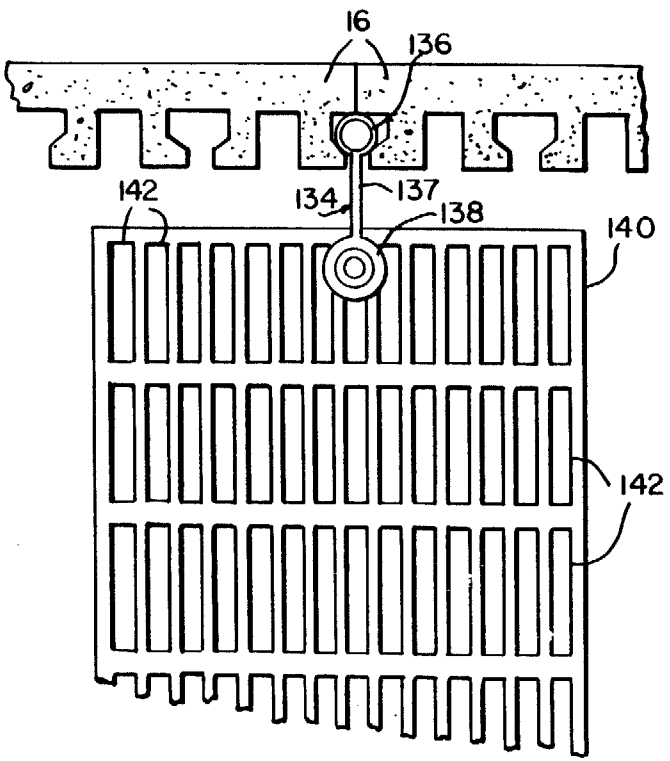
FIG. 14 is a plan view of thin shell elements held in place by a tie member and anchoring grid to define a retaining wall.

FIGS. 14 and 15 depict another embodiment of tie member which can be used with block elements 16 according to the present invention to construct a retaining wall. As can be seen from FIG. 14, a tie member 134 has an end portion 136 of a circular cross section, such as a tube, received in a composite dovetail groove and a web portion 137 having an end 138 connected to a separate opposite end portion defined by a rectangular grid 140 buried in the earth, gravel or other fill material to hold the block elements in place. The grid 140 has a length and a width and extends into the fill material so that the weight of the material bears on the grid and fills a plurality of apertures 142 which the grid defines. The grid 140 is perpendicular to the block elements 16 and extends lengthwise into the fill material. The arrangement shown in FIG. 15 is similar to that of FIG. 14, but the grid is oriented so that its length is parallel to the length of the concrete block elements 16 and perpendicular to the tie members 134. When a plurality of grids 140 are employed in abutment with one another, the perpendicular grids of FIG. 14 cover a greater area than the parallel grids of FIG. 15. Thus, they have more retaining ability than a plurality of the parallel grids and are better suited where the height of fill material above the grids is small.

Figure 16:
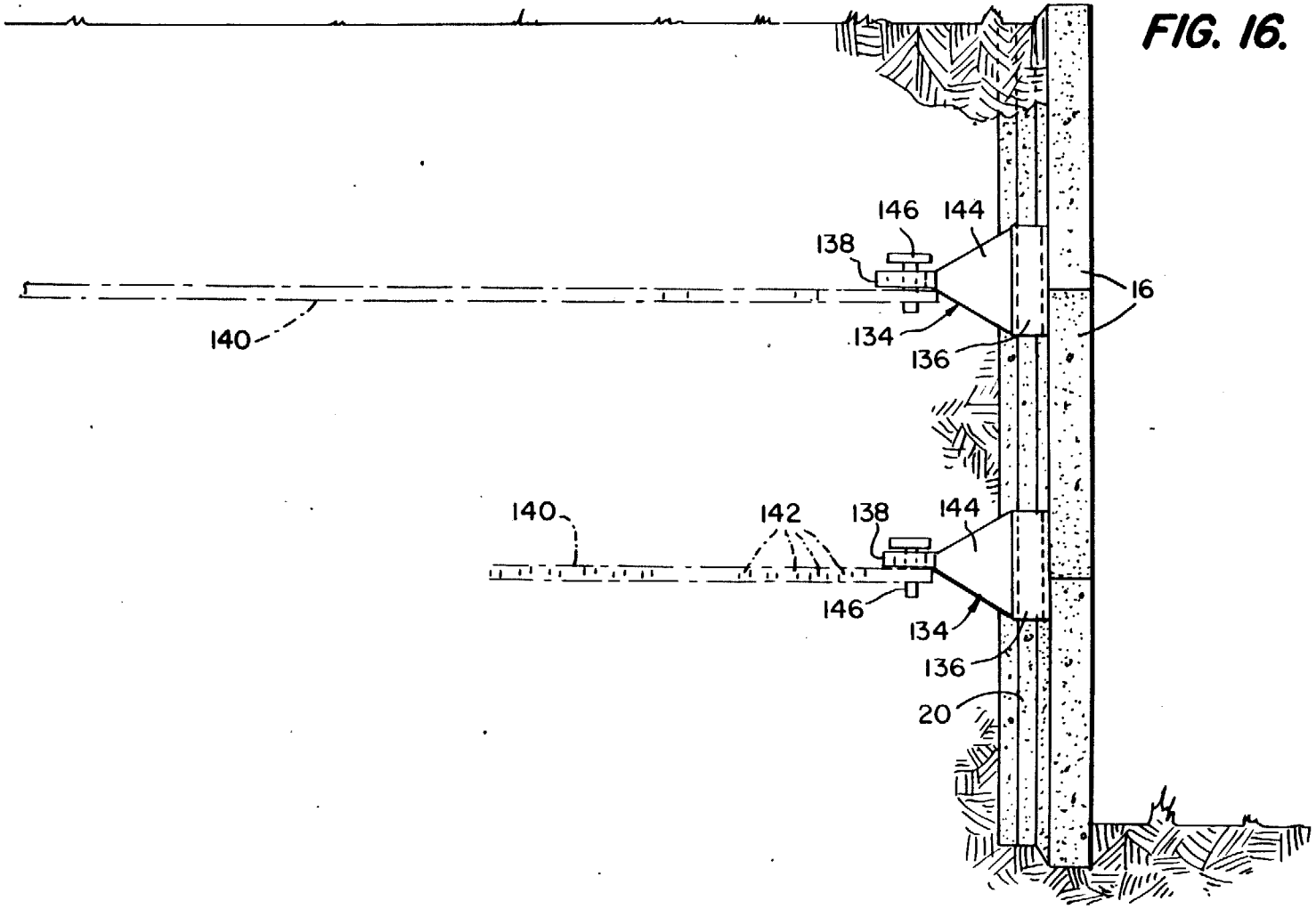
FIG. 16 is a side view showing the anchoring grid arrangements of FIGS. 14 and 15.
Figure 17:
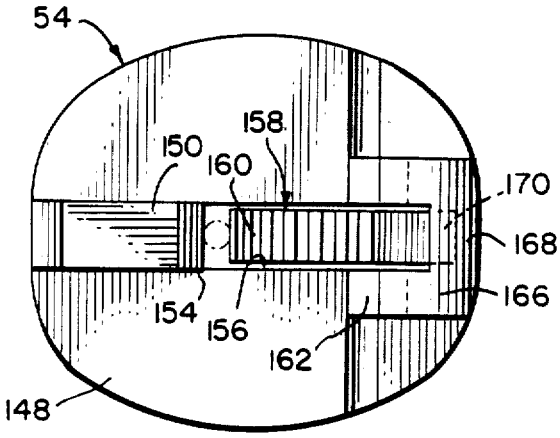
FIG. 17 is a plan view of a cable tensioning anchor for use in the construction forming system according to the present invention.
Figure 18:
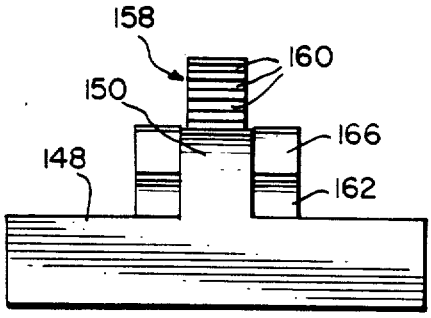
FIG. 18 is a left side view of the cable tensioning anchor of FIG. 17.
Figure 19:
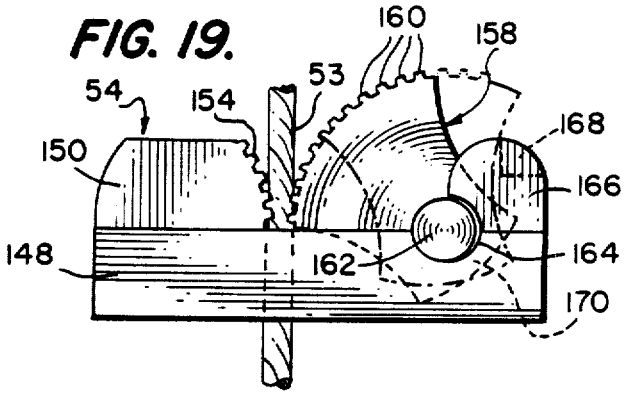
FIG. 19 is a front view of the cable tensioning anchor of FIG. 17.
Figure 20:
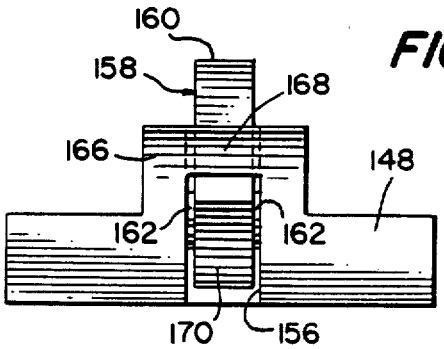
FIG. 20 is a right side view of the cable tensioning anchor of FIG. 17.
Figure 21:
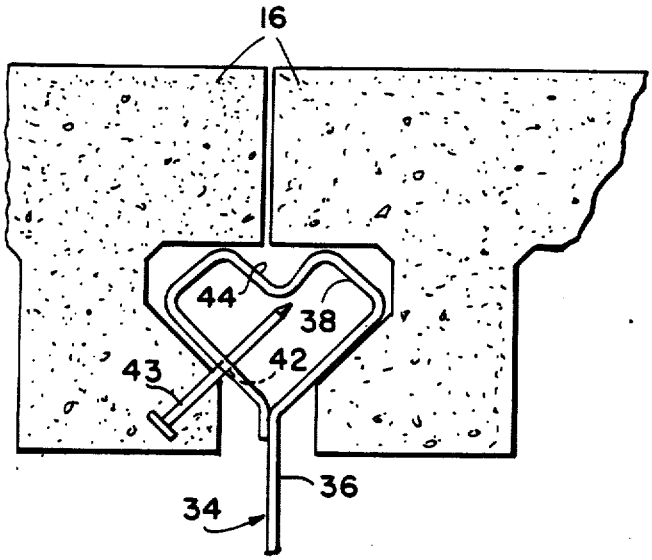
FIG. 21 is a partial plan view of a connecting tie member in a composite groove defined by two thin shell block elements.

As can be seen from FIG. 16, when considered in connection with FIGS. 14 and 15, the web portion 137 is tapered and terminates at its end opposite the end portion 136 in an eye defining an aperture having an axis parallel to the axis of the apertures 142 formed in the grid 142, and overlying one of the apertures 142. Connection between the tie member 134 and the grid 140 can be completed by the insertion of a pin 146 or other element into the eye of the end 138 and the aperture 142 which the eye overlies. Although only one tie member 134 is shown connecting each grid 140 to the block elements 16, a plurality of tie members can be used in connection with each grid. In FIG. 16, the upper grid 140 is oriented perpendicular to the block elements 16 to extend farther into the material, whereas the lower grid 140 is oriented parallel to the block elements and does not extend as far into the earth or other fill material, because the weight of earth bearing upon it is greater than for the upper grid. The end portions 136 are shown contacting ribs 20 of block elements 16 which define one half of a composite dovetail groove, but in practice the end portions 136 would be obscured by block elements which define the other half of the composite dovetail groove.

As can be seen from FIGS. 17–20, the cable tensioning anchor 54 includes a base 148 of generally circular or oblong shape from which an upstanding stationary gripping element 150 extends and defines a curved surface having a plurality of gripping projections 154, which, in the embodiment shown, are parallel ribs or teeth. A slot 156 is defined in the base 148 adjacent to the gripping projections 154 and has positioned therein a pivoting gripping element 158. The pivoting gripping element 158 defines on one end a curved surface having a plurality of gripping projections 160 which cooperate with the gripping projections 154 of the stationary gripping element 150 to clamp and retain in tension a cable which extends through the slot 156 in a space defined between gripping projections 154 and 160. Journals 162 extend from opposite sides of the pivoting gripping element 158 for a snap-fit reception and pivoting movement in curved bearing surfaces 164 defined in the base 148 and in a support structure 166 projecting upward from the base 140 for supporting a stop 168 for limiting the movement of the pivoting gripping element 158. The stop 168 engages the one end of the pivoting gripping element 158 having the gripping projections 160 when the pivoting gripping element is in an inoperative position at one extreme of its travel. The stop 168 also engages a tail portion 170 of the pivoting gripping element 158 which is on an end of the pivoting gripping element lying on an opposite side of the journals 162 from the gripping projections 160 in order to prevent the pivoting gripping element 158 from pivoting beyond a position in which insertion of the cable 53 through the slot 156 in the base 148 will cause the pivoting gripping element 158 to move away from the stationary gripping element 150 and toward the inoperative position. The entire cable tensioning anchor 54 can be made of, for example, metal or plastic.

In operation, the stop 168 maintains the pivoting gripping element 158 in the proper starting position by preventing its curved surface from swinging below the base 140. The cable tensioning anchor 54 is slipped over the end of a cable, such as the cable 53, so that the end of the cable passes through the slot 156 and along the gripping projections 154 on the stationary gripping element 150, pushing the end of the pivoting gripping element 158 having the gripping projections 160 away from the stationary gripping element to the position shown in dashed lines in FIG. 19. Tension is applied to the cable 53, for example, with a tool, and the gripping projections 160 of the pivoting gripping element 158 are pressed by finger pressure into engagement with the cable, thereby clamping the cable between the gripping projections 160 and the gripping projections 154 on the stationary gripping element 150. The tension in the cable 53 pulls the pivoting gripping element 158 against the stationary gripping element 150, thereby increasing the clamping forces securing the cable to the cable tensioning anchor and maintaining the tension in the cable.

Although the block element 16 is described herein as being made of concrete, other suitable materials may be employed. Furthermore, it will be appreciated by those skilled in the art and it is contemplated that variations and/or changes in the embodiments illustrated and described herein may be made without departure from the present invention. For example, although the grooves receiving the tie members have been described throughout the specification as having a dovetail shape, it is understood that grooves of other shapes capable of retaining the end of a tie member can be used, such as grooves of other shapes having a relatively wide bottom and a relatively narrow top. Accordingly, it is intended that the foregoing description is illustrative only, not limiting, and that the true spirit and scope of the present invention will be determined by the appended claims.

What is claimed is:

1. A forming system for construction comprising:

a first panel and a second panel, each said panel including a plurality of block elements, each said block element having a side comprising a planar portion and a plurality of ribs having two ends, said ribs projecting from said planar portion to define grooves having a constant cross section on a continuously increasing cross section from one end of said ribs to the other end so as to permit said block elements to be slipped from a mold, said grooves including grooves configured to receive connecting tie members, each said block element further having ends adjacent the extreme ribs of said plurality of ribs, each said end defining one half of a groove configured to receive the connecting tie members, said ribs and grooves defining a module pattern repeating in each said block element, whereby each said block element can be divided into smaller units each containing at least one said module pattern and having ends defining one half of a groove configured to receive the connecting tie members so that units of sizes smaller than said concrete block elements can be assembled into a panel with other such units and with said concrete block elements, and connecting tie members having end portions received in said grooves, wherein each said end portion includes a stop member for engaging its associated block element at the end of the grooves to support the connecting tie member.

2. The forming system of claim 1, wherein said stop member is integral with said end portion.

3. The forming system of claim 2, wherein the stop member is defined by material struck out from the material of the end portion and projecting from the end portion.

4. The forming system of claim 1, wherein the connecting tie members further comprise web portions extending between said end portions, and said web portions include means for supporting reinforcing elements.

5. The forming system of claim 4, wherein said supporting means comprises notches in each said web portion for supporting elongated reinforcing elements oriented generally orthogonal to the plane of each said web portion.

6. The forming system of claim 4, wherein said supporting means comprises at least one lug extending from each said web portion to support elongated reinforcing elements oriented generally parallel to the plane of said web portion.

7. The forming system of claim 6, wherein said lug is planar and extends at an acute angle from said web portion.

8. The forming system of claim 6, wherein said lug is curved.

9. The forming system of claim 1, wherein the tie members include openings for receiving utility lines.

10. The forming system of claim 1, further comprising means for aiding the distribution of fluent material past said tie members, said distribution aiding means comprising openings in the web portions of said tie members.

11. The forming system of claim 1, wherein a space is defined between said first and second panels, and concrete is positioned in said space.

12. The forming system of claim 1, wherein a space is defined between said first and second panels, and insulation is positioned in said space.

13. The forming system of claim 12, wherein said insulation comprises elongate elements defining together a panel.

14. The forming system of claim 13, wherein each of said elongate insulation elements has a height equal to the height of one of said block elements.

15. The forming system of claim 13, wherein slots are defined in said elongate elements, and said connecting tie members are received in said slots.

16. The forming system of claim 13, wherein said elongate elements include edges having a configuration for interconnecting with the edges of adjacent elongate elements.

17. The forming system of claim 16, wherein at least one of the edges of said elongate elements has a tongue and an engaging edge of the adjacent elongate element has a groove.

18. The forming system of claim 16, wherein said edges of said elongate elements have a shiplap configuration.

19. The forming system of claim 1, wherein a space is defined between said first and second panels, and concrete and insulation are positioned in said space.

20. The forming system of claim 1, wherein said first panel and said second panel are positioned on a foundation, and the forming system further comprises means for holding said block elements against the foundation.

21. The forming system of claim 20, wherein said holding means comprises an elongate member engaging said first and second panels at ends of said panels remote from the foundation, and at least one flexible coilable element under tension connecting said elongate member to the foundation.

22. The forming system of claim 21, further comprising means for transmitting force from said flexible element to said elongate member, wherein said force transmitting means includes a base engaging said elongate member, an opening in said base receiving said flexible element, and means for clamping said flexible element and fixing said force transmitting means to said flexible element.

23. The forming system of claim 1, further comprising means for positioning said first panel and said second panel in predetermined locations relative to a foundation, said positioning means comprising an elongate member to be secured to the foundation.

24. The forming system of claim 23, wherein a course of said block elements closest to said foundation engages said elongate member.

25. The forming system of claim 24, wherein said ribs engage the elongate member.

26. The forming system of claim 24, wherein said elongate member includes means for positioning said connecting tie members at spaced locations along said elongate member.

27. The forming system of claim 26, wherein said means for positioning said connecting tie members comprises a plurality of spaced slots defined in said elongate member.

28. The forming system of claim 26, wherein said elongate member is a channel member.

29. The forming system of claim 28, wherein said channel member includes a bottom wall and side walls, and said means for positioning said connecting tie members comprises a plurality of spaced slots defined in each of said side walls, the slots in each side wall being in alignment with the slots in the other of said side walls.

30. The forming system of claim 29, wherein said connecting tie members include means for centering the connecting tie members with respect to said channel member.

31. The forming system of claim 29, wherein said connecting tie members retain the ribs of said block elements closest to said foundation in engagement with said channel member.

32. The forming system of claim 23, wherein said elongate member is a channel member.

33. The forming system of claim 1, wherein each said block element has peripheral surfaces for engaging adjacent block elements, said peripheral surfaces are perpendicular to said grooves, and the grooves are defined by ribs having first ends spaced from one of said peripheral surfaces to define a recess, said stop member engaging said ribs at said first ends and being positioned within said recess, whereby said stop member avoids interference with the engagement between said block element and adjacent block elements.

34. The forming system of claim 1, wherein said block elements have overall dimensions corresponding to the dimensions of a conventional mold box for molding standard concrete blocks.

35. A wall forming system according to claim 34, wherein each said block element has dimensions of 16 in. × 8 in. × 2.5 in.

36. A wall forming system according to claim 34, wherein some of said grooves are tapered along their length to assist the breaking of vacuum in a mold in which said block elements are formed.

37. A wall forming system according to claim 34, wherein some of said block elements have a first planar portion and a second planar portion defining an angle with said first planar portion to define corner block elements.

38. The forming system of claim 1, wherein said block elements have lateral surfaces engaging lateral surfaces of adjacent block elements, said lateral surfaces having a configuration for interconnecting with the lateral surfaces of the adjacent block elements.

39. The forming system of claim 38, wherein one of said lateral surfaces of said block elements defines a tongue and the other of said lateral surfaces defines a groove.

40. The forming system of claim 39, wherein said lateral surfaces of said block have a shiplap configuration.

41. A wall forming system comprising:

a first panel and a second panel, each said panel including a plurality of block elements, said block elements having a planar portion and ribs defining parallel grooves, and connecting tie members having end portions received in said grooves to connect said first panel to said second panel, said wall forming system further comprising means for positioning said first panel and said second panel in predetermined locations relative to a foundation, said positioning means comprising an elongate member to be secured to the foundation, said elongate member having a bottom wall, side walls extending up from said bottom wall and open ended slots defined in said side walls at equal intervals, wherein said ribs of the block elements engage said sidewalls to position said block elements along a straight line and said connecting tie members are received in said open ended slots to fix said block elements in position.

42. A forming system for construction comprising:

a first panel and a second panel, each said panel including a plurality of block elements, said block elements defining grooves, and connecting tie members having end portions received in said grooves, wherein each said end portion includes a stop member for engaging its associated block element at the end of the grooves to support the connecting tie member, wherein each said block element has peripheral surfaces for engaging adjacent block elements, said peripheral surfaces are perpendicular to said grooves, and the grooves are defined by ribs having first ends spaced from one of said peripheral surfaces to define a recess, said stop member engaging said ribs at said first ends and being positioned within said recess, whereby said stop member avoids interference with the engagement between said block element and adjacent block elements, and further wherein said ribs have, opposite said first ends, second ends flush with another of said peripheral surfaces, said connecting tie members each define a first edge and a second edge, and each said end portion includes a short axial dimension between said stop member and said first edge and a long axial dimension between said stop member and said second edge.

43. The forming system of claim 42, wherein the difference between said long axial dimension and said short axial dimension equals the distance between said first ends of said ribs and said one of said peripheral surfaces, whereby the position of said first edge of the connecting tie member relative to said another of said peripheral surfaces of the block element when said long axial dimension of the end portion is inserted in the end of one of said grooves adjacent the recess is the same as the position of said second edge relative to said one of said peripheral surfaces when the short axial dimension of the end portion is inserted into one of said grooves adjacent the flush second ends of the ribs.

44. A forming system for construction comprising:

a first panel and a second panel, each said panel including a plurality of block elements, said block elements including body portions and ribs projecting from said body portions, said ribs having first and second opposite ends and defining a plurality of grooves, each groove having a length and opposite ends and being open at each of said opposite ends, at least some of said ribs having feet, spaced from said body portions, extending toward adjacent ribs to define restrictions in the grooves between the ribs, and connecting tie members having end portions received in said grooves between said restrictions and said body portions, said end portions being retained in said grooves by the restrictions whereby said connecting tie members join block elements of said first panel with block elements of said second panel, each said end portion of said connecting tie members including a stop member engaging the end of a said rib of its associated block element to locate the connecting tie member relative to the length of the grooves.

* * * * *

UNITED STATES PATENT AND TRADEMARK OFFICE

CERTIFICATE OF CORRECTION

PATENT NO. : 4,703,602

DATED : November 3, 1987

INVENTOR(S) : Jorge Pardo

It is certified that error appears in the above-identified patent and that said Letters Patent is hereby corrected as shown below:

Column 13, line 59, "on" should be --or--.

Signed and Sealed this

Twenty-first Day of June, 1988

*Attest:*

DONALD J. QUIGG

*Attesting Officer*

*Commissioner of Patents and Trademarks*